United States Patent [19]

Keisers et al.

[11] Patent Number: 4,781,238

[45] Date of Patent: Nov. 1, 1988

[54] REFRACTORY CHANNEL CONNECTION APPARATUS IN A METALLURGICAL VESSEL

[75] Inventors: Laurenz Keisers; Kurt Engelmann, both of Krefeld; Johannes Steins, Erkrath, all of Fed. Rep. of Germany

[73] Assignees: Didier-Werke AG, Wiesbaden; Karf Engineering GmbH, Dusseldorf, both of Fed. Rep. of Germany

[21] Appl. No.: 71,255

[22] Filed: Jul. 8, 1987

[30] Foreign Application Priority Data

Jul. 16, 1986 [DE] Fed. Rep. of Germany ..... 3623937

[51] Int. Cl.[4] ..... B22D 11/10

[52] U.S. Cl. ..... 164/415; 164/434; 164/437

[58] Field of Search ..... 164/415, 433, 434, 437, 164/438, 439, 440

[56] References Cited

U.S. PATENT DOCUMENTS 4,386,958 6/1983 Tyler et al. ..... 164/437
4,555,050 11/1985 Schiefer et al. ..... 164/437

FOREIGN PATENT DOCUMENTS 56-105853 8/1981 Japan ..... 164/434
396166 1/1974 U.S.S.R. ..... 164/415

*Primary Examiner*—Nicholas P. Godici
*Assistant Examiner*—Richard K. Seidel
*Attorney, Agent, or Firm*—Wenderoth, Lind & Ponack

[57] ABSTRACT

A refractory channel connection apparatus transfers molten metal from a metallurgical vessel into a mold of a continuous casting machine formed by a peripheral groove and a casting wheel and a band covering the open side of the groove. The channel connection apparatus includes a refractory pouring tube having an inlet end connected to the discharge nozzle of the metallurgical vessel, an outlet end and a molten metal passage extending from the inlet end to the outlet end. A refractory nozzle extension is provided at the outlet end of the pouring tube, the nozzle extension having therethrough a flow through passage communicating with the passage of the pouring tube, an outer profile dimensioned to extend tangentially into the mold and to define therewith a gas seal slot, and a lower end extending into the mold to a level above the upper level of metal cast therein. Compressed inert gas is supplied to a chamber including the flow through passage and the space above the upper level of the metal in the ingot mold, thereby pressurizing such chamber and the slot and preventing exterior air from entering the chamber through the slot and contacting the metal in the mold.

23 Claims, 2 Drawing Sheets

REFRACTORY CHANNEL CONNECTION APPARATUS IN A METALLURGICAL VESSEL

BACKGROUND OF THE INVENTION

The present invention relates to a refractory channel connection apparatus for transferring molten metal, particularly molten steel, from a metallurgical vessel, particularly a tundish, into an ingot mold of a continuous casting machine, and particularly of the type wherein the ingot mold is formed by a peripheral groove in a rotating casting wheel and a metal band covering the open side of the groove. The present invention further is directed to an assembly including the combination of such a metallurgical vessel, continuous casting machine and refractory channel connection apparatus.

When molten metal is transferred to the mold by a pouring tube connected to the metallurgical vessel discharge nozzle without a casting tube providing protection against reoxidation of the molten metal, the pouring stream of molten metal enters the rotating ingot mold in a free fall. This is satisfactory for the continuous casting of steel of average grade since reoxidation of the steel is of no importance. The situation is different however during the continuous casting of high grade steels, since in such situation the molten metal must be prevented from coming into contact with the exterior air during solidification. Thus, it is critical that there be an air tight transfer of the molten metal from the pouring tube into the ingot mold. This is difficult to achieve since the pouring tube cannot project into or below the level of the molten steel in the ingot mold to prevent arcings, and also due to the fact that normal packings or seals create problems due to the configuration of the inlet to the ingot mold.

SUMMARY OF THE INVENTION

With the above discussion in mind, it is an object of the present invention to provide an improved refractory channel connection apparatus whereby it is possible to ensure in a simple manner an air tight transfer of molten metal, particularly steel, into a rotating ingot mold of a casting wheel type continuous casting machine. It is a further object of the present invention to provide such a refractory channel connection apparatus which operates reliably and which readily can be adapted to surrounding structures or particular installations. It is a still further object of the present invention to provide an assembly of a metallurgical vessel, particularly a tundish, and a continuous casting machine of the above type, but improved to include the refractory channel connection apparatus of the present invention.

The above objects are achieved in accordance with the present invention by the provision of a refractory channel connection apparatus including a refractory pouring tube having an inlet end connected to the discharge nozzle of the metallurgical vessel, an outlet end and a molten metal passage extending from the inlet end to the outlet end. A refractory nozzle extension is provided at the outlet end of the pouring tube, and the nozzle extension has therethrough a flow through passage communicating with the passage of the pouring tube. The outer profile of the nozzle extension is dimensioned to extend tangentially into the ingot mold and to define therewith a slot. Furthermore, the nozzle extension has a lower end which extends into or is positioned within the ingot mold to a level above the upper level of the molten metal cast therein. As a result, there is formed a chamber including the flow through passage in the nozzle extension and a space above the upper level of the molten metal within the ingot mold. There is further provided mean for forming a pressurized gaseous atmosphere, for example with inert gas, within the chamber. As a result, the exterior air is prevented from entering the chamber through the slot and contacting the molten metal within the ingot mold. That is, the pressurized or compressed inert gas builds up a gas cushion surrounding the pouring stream of molten metal within the flow through passage and within the space above the upper level or meniscus of the molten metal cast within the ingot mold. This gas cushion fills the slot between the nozzle extension and the walls of the casting wheel and the band which form the ingot mold, and thereby ensures that the molten metal is shielded from the exterior air. The provision of this type of gas seal slot ensures a relative clearance between the walls of the mold and the nozzle extension and also facilitates the insertion of the nozzle extension into the mold to the operating position.

The nozzle extension can be designed as an element separate from the pouring tube and can be connected to the pouring tube by means of tighteners. Furthermore, the nozzle extension can be provided with a gas channel extending therethrough to the flow through passage and connected to a gas inlet connection for supplying the compressed inert gas into the chamber. The compressed gas inlet connection and bases for the tightening devices advantageously are provided on the end face of the nozzle extension directed toward the pouring tube. Furthermore, an elastic ceramic fiber seal may be positioned between the outlet end of the pouring tube and the inlet end of the nozzle extension. However, it also is possible, with a particular outer configuration, to fit the nozzle extension to a pouring tube which itself supports a compressed gas inlet connection. Also, it is possible in accordance with the present invention to combine the nozzle extension and the pouring tube into a one-piece structure. This leads to advantages in the handling of the channel connection apparatus and is particularly recommended for the casting of fairly small cross section metal strands.

The refractory nozzle extension is designed, in all cases, such that the flow through passage thereof has an inlet end with a cross section corresponding to that of the outlet end of the passage through the pouring tube, but with an outlet end cross-sectional configuration adapted to but smaller than the cross section of the ingot mold. In other words, the interior cross sectional configuration of the flow through passage changes from a configuration corresponding to that of the outlet end of the pouring tube to a configuration generally proportional to the cross section of the ingot mold. However, the size of the outlet end of the flow through passage is smaller than the cross section of the ingot mold. By this arrangement, the inert gas passing through the flow through passage and into the space is easily supplied and equally distributed to the gas seal slot. In other words, the shape of the flow through passage at the outlet end thereof, the thickness of the walls of the nozzle connection at the outlet end and the shape of the nozzle extension at the outlet end all are dimensioned to ensure uniform distribution of the inert gas from the flow through passage to the gas seal slot.

The invention further provides the feature that the inlet end of the pouring tube is connected to a sleeve of the discharge nozzle or downspout of the metallurgical vessel supporting a metering nozzle. Additionally, the metallurgical vessel includes a cast-start chamber leading to the discharge nozzle and separated from the remainder of the interior of the metallurgical vessel by a wall. Such a nozzle construction at the beginning of the channel connection apparatus structure for the attachment of the pouring tube to the metallurgical vessel is very well suited for open stream casting of the molten metal. This particularly is true because of the build-up of ferrostatic pressure within the metallurgical vessel, since it ensures that only hot molten metal can be cast started. As a result, the danger of metal freezing in the channel connection apparatus is largely avoided. Furthermore, foreign matter, such as cast-start sand, cannot push forward into the channel connection apparatus during the opening of a ladle for filling of the metallurgical vessel, particularly a tundish.

BRIEF DESCRIPTION OF THE DRAWINGS

Other objects, features and advantages of the present invention will be apparent from the following detailed description of preferred arrangements thereof, with reference to the accompanying drawings, wherein.

DETAILED DESCRIPTION OF THE INVENTION

Figure 1:
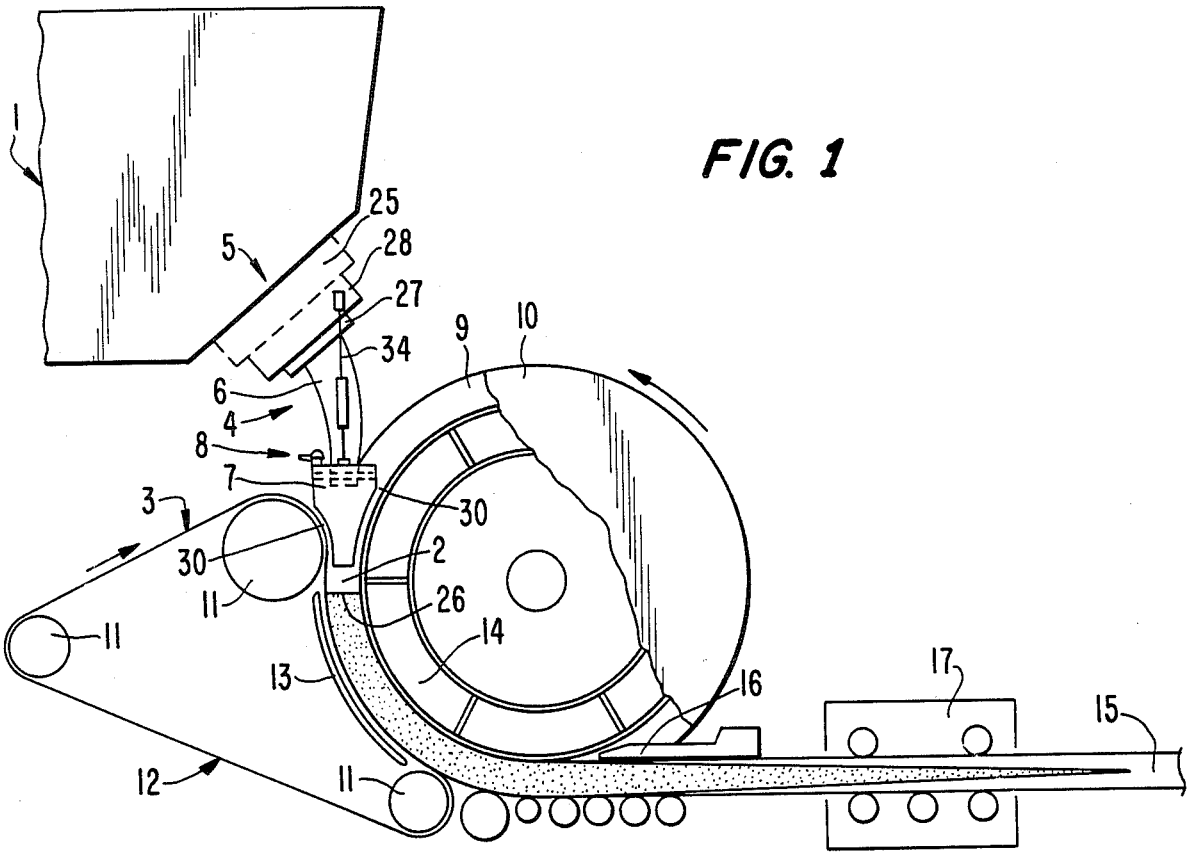
FIG. 1 is a schematic view of a refractory channel connection apparatus mounted between a tundish and an ingot mold of a casting wheel continuous casting machine according to the present invention.
Figure 2:
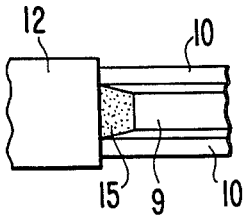
FIG. 2 is a partial top view of the ingot mold.

In FIG. 1 there is shown the area of the downspout or discharge nozzle of a tundish 1 from which molten metal, particularly high grade steel, is discharged to an ingot mold 2 of a casting wheel type continuous casting machine 3. A refractory channel connection apparatus 4 achieves transfer of the molten metal while avoiding contacting the molten metal by the exterior air. Ingot mold 2 is formed by a peripheral groove 9 in a rotating casting wheel 10 and a band, preferably a steel band 12, which covers the open side of groove 9 and which moves over rollers 11. Steel band 12 includes a cooling device 13 in the area of the ingot mold, and casting wheel 10 is provided with cooling chambers 14. Molten metal is discharged from tundish nozzle 5 through refractory channel connection apparatus 4 into ingot mold 2 to continuously form therein a cast steel strand 15. As shown in FIG. 2, ingot mold 2 has a trapezoidal cross section. The cast strand solidifies and is removed from casting wheel 10 at 16 by means of a straightening unit 17.

Figure 3:
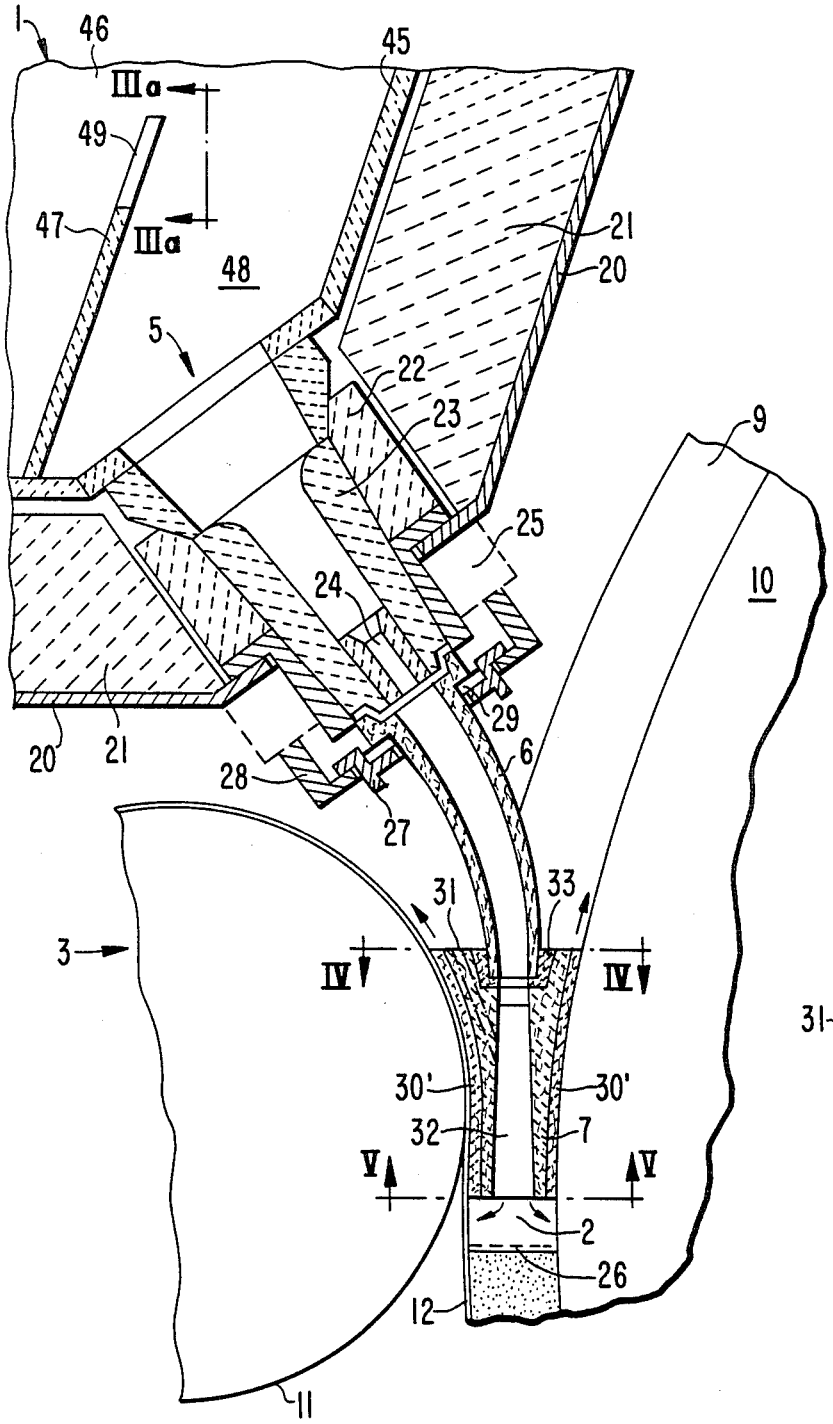
FIG. 3 is an enlarged cross sectional view of the refractory channel connection apparatus.

As shown in more detail in FIG. 3, tundish 1 has a metal shell 20 and a refractory lining 21 within which is inserted a refractory block 22 having a refractory sleeve 23 which in turn supports at the outlet of a passage therethrough a refractory metering nozzle 24 dimensioned to a desired flow rate. In the event that a disruption of the discharge of the molten steel from tundish occurs, for example due to rupture of a pouring tube, an emergency slide gate 25 is provided to protect the environment of ingot mold 2 and to abruptly stop the flow of molten steel, for example should sleeve 23 be destroyed. Metering nozzle 24 is metered by known hydrodynamic principles and the material therefore is extremely wear and erosion resistant so as not to rapidly expand. Emergency slide gate or valve 25 bounds the discharge in the manner of a bulkhead and operates to shut-off the molten flow in the event of nozzle failure.

The refractory channel connection apparatus of the present invention includes a pouring tube 6 having an inlet end connected to the discharge nozzle 5, and specifically to sleeve 23 by means of a bayonet fitting 27 acting on a mating profile 28 secured to casing 20. Washer 29 may be provided between fitting 27 and the inlet end of pouring tube 6. Pouring tube 6 has therethrough a molten metal passage and is adapted in shape and design to the particular local conditions or to the available space between the tundish and the continuous casting machine 3. Pouring tube 6 may have the curved shape shown in FIG. 3 or may have a rectilinear shape.

At the outlet end of pouring tube 6 is a refractory nozzle extension 7 having therethrough a flow through passage 32 communicating with the passage through the pouring tube 6. Nozzle extension 7 has an exterior configuration and profile dimensioned to extend tangentially or complementarily into ingot mold 2 and to define therewith a gas seal slot 30 (FIG. 1). The lower end of nozzle extension 7 extends into ingot mold 2 only to a level above the upper level or meniscus 26 of the molten steel cast therein.

A gas channel 31 extends through nozzle extension 7 to the flow through opening 32, and an inert gas connection 8 (FIG. 1) is connected to channel 31. Accordingly, compressed or pressurized inert gas is supplied through channel 31 into flow through passage 32 and fills a chamber including the flow through passage 32 surrounding a molten metal stream therein and a space between the upper level 26 of cast molten metal and the outlet end of nozzle extension 7. The compressed inert gas thus fills the gas seal slot 30 and prevents outside air from entering therein into the chamber. Accordingly, the cast molten metal as well as the molten metal stream are totally isolated from the exterior air.

However, in accordance with a further feature of the present invention it is possible to provide within the gas seal slot 30 a seal 30' of a ceramic fiber material and through which inert gas may escape under pressure.

Furthermore, the configuration of flow through passage 32 changes from the inlet end thereof to the outlet end thereof. Thus, the inlet end of flow through passage 32 has a cross-sectional shape matching that of the outlet end of the passage through pouring tube 6. However, the outlet end of flow through passage 32 has a cross-sectional shape proportional to but smaller than the cross section of ingot mold 2. More particularly, the exterior shape of the outlet end of nozzle extension 7, the thickness of the walls of the outlet end of nozzle extension 7 and the configuration of the outlet end of passage 32 are provided to ensure a substantially uniform distribution of the inert gas being discharged from passage 32 to the gas seal slot 30. Further, an elastic ceramic fiber seal 33 is positioned between the outlet end of pouring tube 6 and the inlet end of nozzle extension 7, thereby preventing exterior air from leaking therebetween. Tightening devices 34 (FIG. 1) urge the nozzle extension 7 toward the pouring tube 6 and thereby compress the elastic ceramic fiber seal 33. Tightening devices 34 have upper ends connected, for example, to profile 28 and lower ends having cross pins 36 fitted within recesses 35 on the upper surface of the upper face of nozzle extension 7. By thus positioning gas inlet connection 8 and the tightening devices 34, such elements are located conveniently with regard to operation and mounting and dismounting of the channel connection apparatus.

Figure 6:
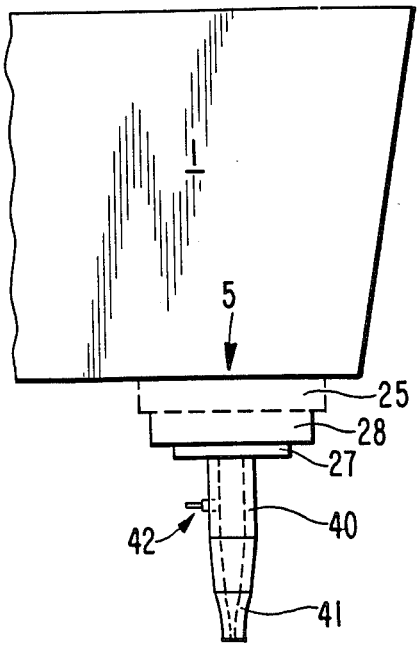
FIG. 6 is a partial view similar to FIG. 1 but showing a modified arrangement of the channel connection apparatus of the present invention.

However, other connecting arrangements are possible. For example, pouring tube 6 and nozzle extension 7 can be provided at least partly with sheet metal sleeves which can be joined together by screwthreads. Furthermore, as shown in FIG. 6, with a suitable surrounding environment between tundish 1 and casting machine 3, a pouring tube 40 connected by means of bayonet fittings 27, 28 to discharge nozzle or downspout 5 can be employed. The lower end of pouring tube 40 can be formed as a nozzle extension 41 configured in the above discussed manner. The result of this arrangement is a one-piece structure of channel connection apparatus 40, 41 which is supplied with inert gas via an inlet connection 42. Furthermore, the gas inlet connection may be connected to a pouring tube formed separately from the nozzle extension.

Figure 3A:
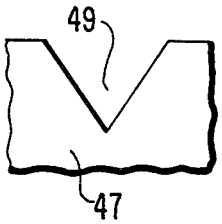
FIG. 3*a* is a detail taken in the direction of arrows IIIa—IIIa in FIG. 3.
Figure 4:
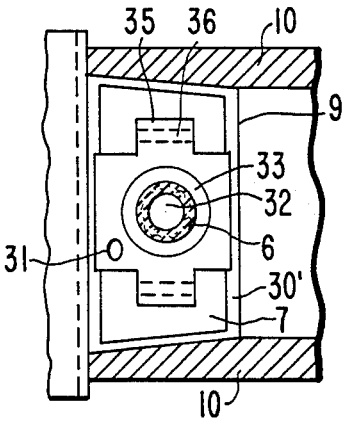
FIG. 4 is a cross sectional view taken along IV—IV of FIG. 3.
Figure 5:
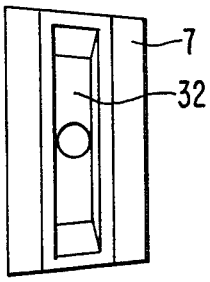
FIG. 5 is a bottom view taken in the direction of arrows V—V of FIG. 3.

FIGS. 3 and 3*a* illustrate an additional feature of the present invention wherein the interior 46 of tundish 1, provided with insulating plates or layers 45, is subdivided by means of a partition wall 47 to define a casting chamber or cast-start chamber 48 which separates the area of the downspout or discharge nozzle 5 from the remainder of the interior 46. Partition wall or walls 47 are provided with one or more overflow profiles 49 to prevent a surge effect which builds up the ferrostatic pressure required for casting. This type of arrangement facilitates open stream casting. If conventional stopper rods or slide gates are used instead of open stream casting, the cast-start chamber 48 need not be provided.

Although the present invention has been described and illustrated with respect to preferred features of the present invention, it will be apparent that various changes and modifications may be made to the specifically described and illustrated features without departing from the scope of the present invention.

We claim:

1. A refractory channel connection apparatus for transferring molten metal from a metallurgical vessel into a mold of a continuous casting machine formed by a peripheral groove in a casting wheel and a band covering the open side of the groove, while isolating the metal from the exterior air, said refractory channel connection apparatus comprising:

a refractory pouring tube having an inlet end to be connected to a discharge nozzle of the metallurgical vessel, an outlet end and a molten metal passage extending from said inlet end to said outlet end;

a refractory nozzle extension as said outlet end of said pouring tube, said nozzle extension having therethrough a flow through passage communicating with said passage of said pouring tube, an outer profile dimensioned to extend tangentially into the mold and to define therewith a slot, and a lower end to extend into the mold to a level above the upper level of metal cast therein, said flow through passage having an inlet end with a cross-sectional shape matching that of the outlet end of said passage of said pouring tube and an outlet end with a cross-sectional shape proportional to but smaller than the cross section of the mold;

means for forming a pressurized gaseous atmosphere within a chamber including said flow through passage and a space above the upper level of metal in the mold and thereby for preventing exterior air from entering said chamber through said slot and contacting the metal in the mold; and a ceramic fiber seal surrounding at least a portion of said outer profile of said nozzle extension to be positioned within said slot for sealingly engaging said nozzle extension with the mold.

2. An apparatus as claimed in claim 1, wherein said nozzle extension is formed as an element separate from said pouring tube, and further comprising means for connecting an upper end of said nozzle extension to said outlet end of said pouring tube.

3. An apparatus as claimed in claim 2, wherein said connecting means comprises tightening means connected to said upper end of said nozzle extension and to be connected to the metallurgical vessel for urging said nozzle extension upwardly toward said pouring tube.

4. An apparatus as claimed in claim 2, wherein said gaseous atmosphere forming means comprises a gas channel extending through said nozzle extension to said flow through passage, and a compressed gas inlet connection connected to said gas channel for supplying compressed gas thereto and into said chamber.

5. An apparatus as claimed in claim 4, wherein said gas inlet connection is located at said upper end of said nozzle extension.

6. An apparatus as claimed in claim 2, further comprising an elastic ceramic fiber seal positioned between said pouring tube and said nozzle extension.

7. An apparatus as claimed in claim 1, wherein said nozzle extension and said pouring tube comprise a one-piece construction.

8. An apparatus as claimed in claim 7, wherein said gaseous atmosphere forming means comprises a gas channel extending through said one-piece construction to said flow through passage, and a compressed gas inlet connection connected to said gas channel for supplying compressed gas thereto and into said chamber.

9. An apparatus as claimed in claim 1, wherein said gaseous atmosphere forming means comprises a compressed gas inlet connection on said pouring tube and connected to a gas channel leading to said flow through passage for supplying compressed gas thereto and into said chamber.

10. An apparatus as claimed in claim 1, wherein the discharge nozzle of the metallurgical vessel includes a sleeve supporting metering nozzle, and further comprising means for connecting said inlet end of said pouring tube to the sleeve.

11. An apparatus as claimed in claim 1, wherein said cross-sectional shape of said flow through passage changes from said inlet end thereof to said outlet end thereof.

12. In an assembly of continuous casting machine including a mold formed by a peripheral groove in a casting wheel and a band covering the open side of the groove, and a metallurgical vessel having a discharge nozzle for discharging molten metal into said mold, the improvement of a refractory channel connection apparatus for transferring the molten metal from said discharge nozzle to said mold while isolating the metal from the exterior air, said apparatus comprising:

a refractory pouring tube having an inlet end connected to said discharge nozzle of said metallurgical vessel, an outlet end and a molten metal passage extending from said inlet end to said outlet end;

a refractory nozzle extension at said outlet end of said pouring tube, said nozzle extension having therethrough a flow through passage communicating with said passage of said pouring tube, an outer profile extending tangentially into said mold and defining therewith a slot, and a lower end positioned within said mold to a level above the upper level of metal cast therein, said flow through passage having an inlet end with a cross-sectional shape matching that of the outlet end of said passage of said pouring tube and an outlet end with a cross-sectional shape proportional to but smaller than the cross section of said mold;

means for forming a pressurized gaseous atmosphere within a chamber including said flow through passage and a space above the upper level of metal in said mold and thereby for preventing exterior air from entering said chamber through said slot and contacting the metal in said mold; and a ceramic fiber seal surrounding at least a portion of said outer profile of said nozzle extension and positioned within said slot for sealingly engaging said nozzle extension with said mold.

13. The improvement claimed in claim 12, wherein said nozzle extension is formed as an element separate from said pouring tube, and further comprising means for connecting an upper end of said nozzle extension to said outlet end of said pouring tube.

14. The improvement claimed in claim 13, wherein said connecting means comprises tightening means connected to said upper end of said nozzle extension and connected to said metallurgical vessel for urging said nozzle extension upwardly toward said pouring tube.

15. The improvement claimed in claim 13, wherein said gaseous atmosphere forming means comprises a gas channel extending through said nozzle extension to said flow through passage, and a compressed gas inlet connection connected to said gas channel for supplying compressed gas thereto and into said chamber.

16. The improvement claimed in claim 15, wherein said gas inlet connection is located at said upper end of said nozzle extension.

17. The improvement claimed in claim 13, further comprising an elastic ceramic fiber seal positioned between said pouring tube and said nozzle extension.

18. The improvement claimed in claim 12, wherein said nozzle extension and said pouring tube comprise a one-piece construction.

19. The improvement claimed in claim 18, wherein said gaseous atmosphere forming means comprises a gas channel extending through said one-piece construction to said flow through passage, and a compressed gas inlet connection connected to said gas channel for supplying compressed gas thereto and into said chamber.

20. The improvement claimed in claim 12, wherein said gaseous atmosphere forming means comprises a compressed gas inlet connection on said pouring tube and connected to a gas channel leading to said flow through passage for supplying compressed gas thereto and into said chamber.

21. The improvement claimed in claim 12, wherein said discharge nozzle of said metallurgical vessel includes a sleeve supporting a metering nozzle, and further comprising means for connecting said inlet end of said pouring tube to said sleeve.

22. The improvement claimed in claim 21, wherein said metallurgical vessel includes a cast-start chamber leading to said discharge nozzle and separated from the remainder of the interior of said metallurgical vessel by a wall.

23. The improvement claimed in claim 12, wherein said cross-sectional shape of said flow through passage changes from said inlet end thereof to said outlet end thereof.

* * * * *